US005421742A

United States Patent [19]

Huang

[11] Patent Number: 5,421,742

[45] Date of Patent: Jun. 6, 1995

[54] ELECTRIC LAMP BASE SYSTEM

[76] Inventor: Shun-Feng Huang, No. 13, Lane 84, Nei Hu Road, Hsin-Chu City, Taiwan, Prov. of China

[21] Appl. No.: 226,336

[22] Filed: Apr. 12, 1994

[51] Int. Cl.[6] ..... H01R 13/00

[52] U.S. Cl. ..... 439/419

[58] Field of Search ..... 439/602, 605, 418, 419, 439/425, 611

[56] References Cited

U.S. PATENT DOCUMENTS

| | | | |
|---|---|---|---|
| 2,647,246 | 7/1953 | Gilbert | 439/419 |
| 2,800,635 | 7/1957 | Christenberry | 439/419 |
| 3,372,362 | 3/1968 | Schick | 439/419 |
| 3,716,818 | 2/1973 | Finkelstein | 439/419 |
| 4,382,654 | 5/1983 | Schick | 439/602 |
| 4,660,919 | 4/1987 | Levy | 439/418 |
| 4,777,573 | 10/1988 | Liao | 439/419 X |
| 4,778,409 | 10/1988 | Maddock | 439/602 |
| 4,807,098 | 2/1989 | Ahroni | 439/419 X |
| 5,051,877 | 9/1991 | Liao | 439/419 X |
| 5,328,385 | 7/1994 | Cheu | 439/425 |

FOREIGN PATENT DOCUMENTS

| | | | |
|---|---|---|---|
| 2682226 | 4/1993 | France | 439/425 |
| 610157 | 10/1060 | Italy | 439/419 |

*Primary Examiner*—William Briggs

*Attorney, Agent, or Firm*—Morton J. Rosenberg; David I. Klein

[57] ABSTRACT

An electric lamp base system is provided. The lamp base includes a cylindrical socket with an inner threaded portion to receive a screw base lamp. One conductor of the lamp base is disposed in a groove formed through the threaded portion of the socket and has its bottom end adapted for insert into a lead wire. The other conductor of the lamp base extends vertically through the bottom of the socket to contact a bottom conductor of the lamp, and has its bottom end adapted for insert into another lead wire. A cap is provided with two upward projecting retaining members for locking engagement with openings formed in the bottom of the socket. The two lead wires are disposed within a straight horizontal groove formed in the bottom of the socket. The two conductors are located far from each other, without any possibility of mutual contact to cause a short circuit.

1 Claim, 3 Drawing Sheets

ELECTRIC LAMP BASE SYSTEM

BACKGROUND OF THE INVENTION

A conventional electric lamp base system shown in FIGS. 5 and 6 includes a cylindrical socket 10, two conductors 20, 30, and a cap 40 combined together. The socket 10 has a threaded portion 101 in an inner wall for screwing with a lamp. One of two conductor 20 is vertically fixed on an inner wall of the socket 10 having a pointed lower end 201, and the other conductor 30 is fixed laterally on a bottom of the socket 10, having a pointed projection 301 from one end. Two lead wires 50 are deposited laterally through under the bottom of the socket 10, and the pointed ends 201, 301 of the two conductors 20, 30 prick in the two lead wires to conduct electricity. The cap 40 has a projecting-up portion 401 to fit in a center hole 103 in the bottom of the socket 10 and to press up tightly the two lead wires 50 when the cap 40 is fixed to close on the bottom of the socket 10 from under. When this system is in manufacturing process, one end of the conductor 30 is bent down to contact one pole of the lamp. But the two conductors 20, 30 are often found to be in contact with each other to cause short-circuit made by careless or erroneous work of workers, and thus causing probable fire.

SUMMARY OF THE INVENTION

An electric lamp base system in the present invention includes a conductor fitted in an inner wall of a cylindrical socket and contacting with a circumferential threaded portion of a lamp and its bottom end inserting in a lead wire to conduct electricity, and another conductor fitted straight in a hole in a bottom of the socket and having its upper end bent to contact with a bottom end of a lamp and its bottom end inserting in another lead wire to conduct electricity. The two lead wires are put through a straight horizontal groove in the bottom of the socket and presses firmly by a diametrical straight portion on the bottom of a cap closed on the bottom of the socket from under. Consequently, the two conductors are located far from each other, without possibility of mutual contact to cause short-circuit.

BRIEF DESCRIPTION OF DRAWINGS

The invention will be better understood by reference to the accompanying drawings, wherein.

DESCRIPTION OF THE PREFERRED EMBODIMENTS

Figure 4:
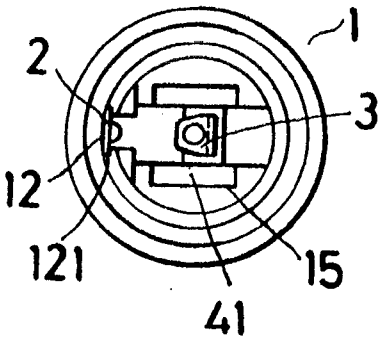
FIG. 4 is an upper view of the electric lamp base system in the present invention.
Figure 1:
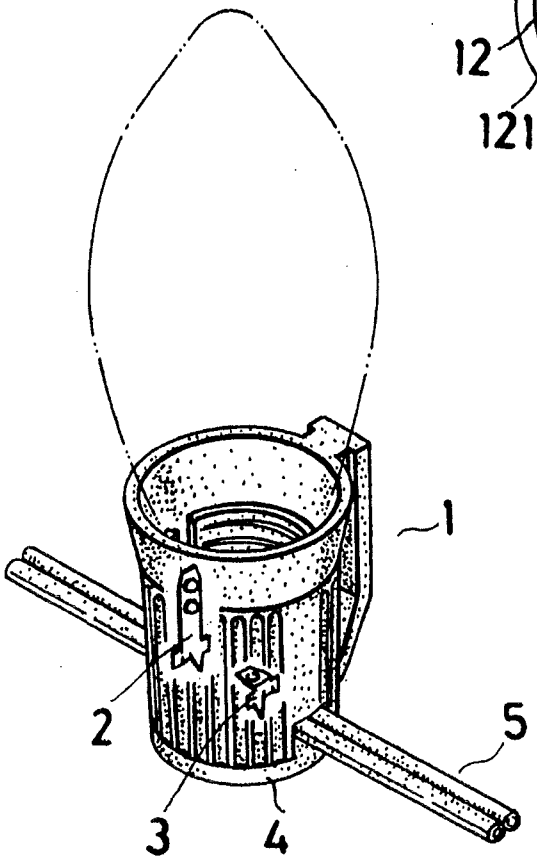
FIG. 1 is a perspective view of an electric lamp base system in the present invention.
Figure 2:
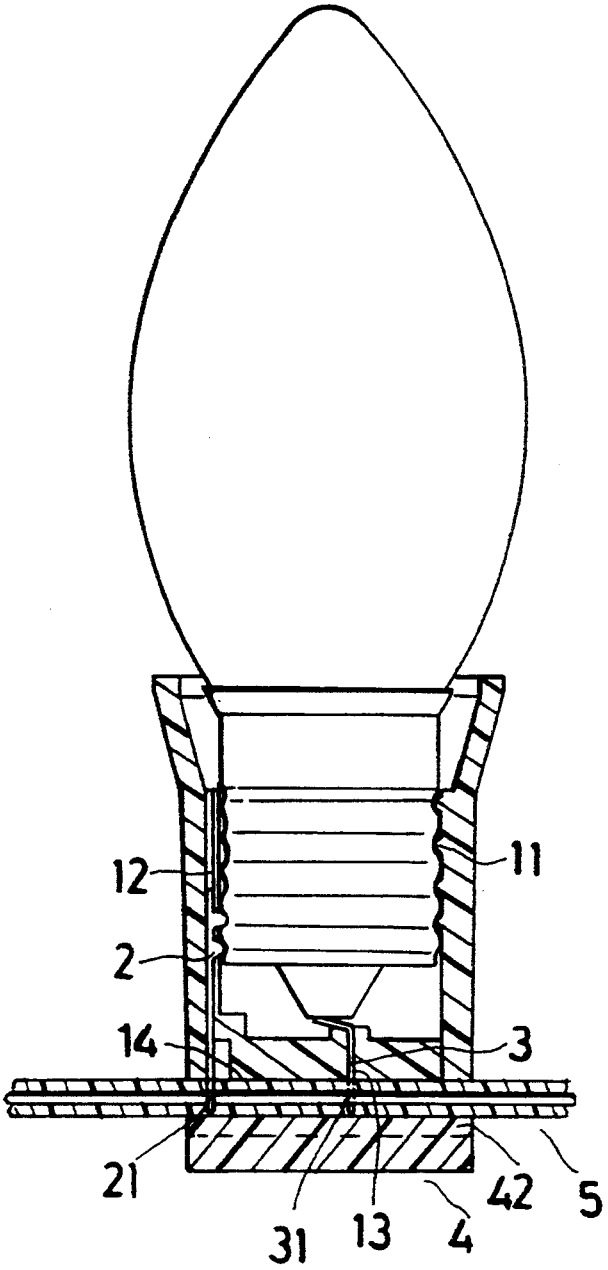
FIG. 2 is a front cross-sectional view of the electric lamp base system in the present invention.
Figure 3:
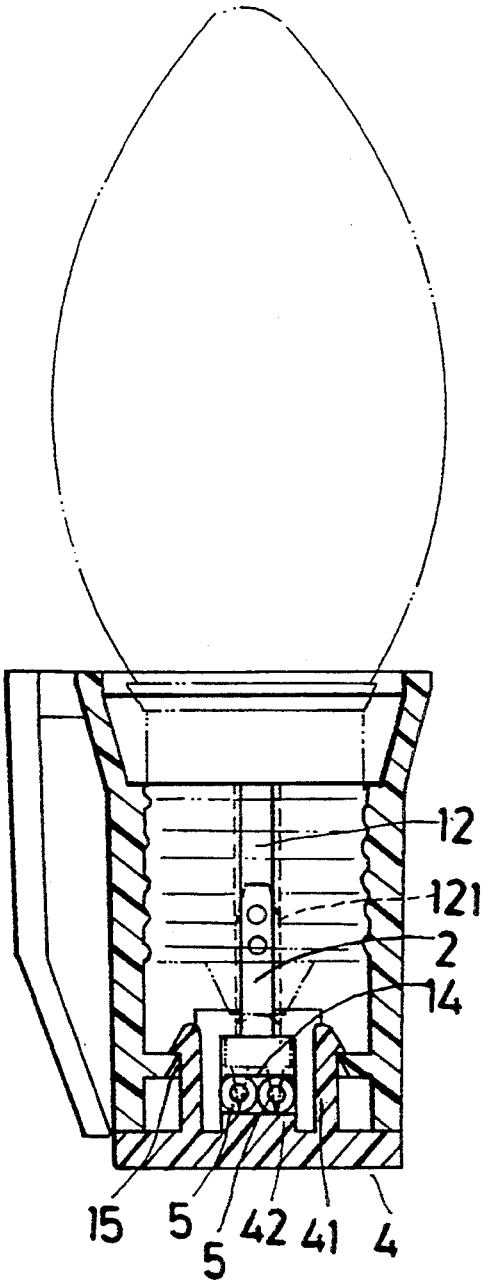
FIG. 3 is a side cross-sectional view of the electric lamp base system in the present invention.
Figure 6:
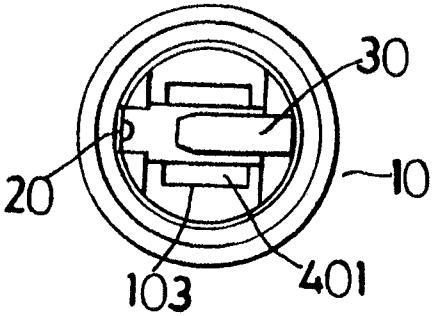
FIG. 6 (PRIOR ART)
Figure 5:
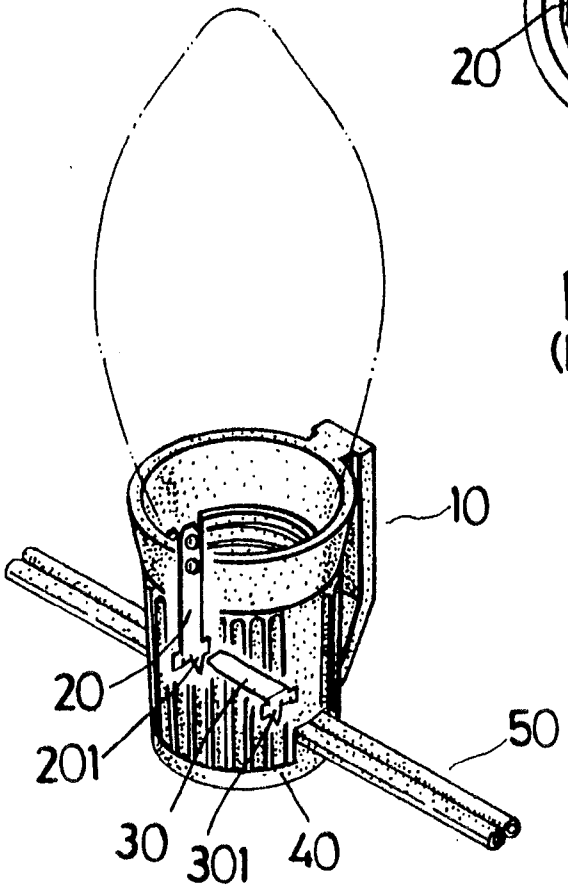
FIG. 5 (PRIOR ART)
FIG. 5 is a perspective view of a conventional electric lamp base system; and, FIG. 6 is an upper view of the conventional electric lamp base system.

An electric lamp base system in the present invention, as shown in FIGS. 2 and 3, includes a socket 1, two conductors, a cap 4 combined together. The socket is provided with a threaded portion 11 for a lamp to screw with, a straight groove 12 and a position groove 121 extending laterally to both sides from the straight groove 12 in an inner wall for a conductor 2 to engage therein to be firmly positioned as shown in FIG. 4. A through hole 13 is also provided in a bottom of the socket 1, preferably in its center, for a rather short conductor 3 to engage therein. The two conductors 2 and 3 have respectively a lower end 21, 31 to insert in two lead wires. The socket i also has a straight horizontal groove 14 in the bottom for two lead wires to pass through therein, and a center hole 15 in the bottom portion for two upright walls 41 of a cap 4 to fit therein. The cap 4 has a diametrical straight projection 42 on an upper surface to press the two lead wires 5, 5 firmly, keeping the wires 5, 5 in place.

In assembling, as shown in FIGS. 2 and 3, the two conductors 2 and 3 are respectively deposited in the straight groove 12, and the hole 13 of the socket 1. Then the two lead wires 5 are inserted through the straight groove 14, and the projecting-up walls 41 of the cap 4 are put to fit in the center hole 15 and the diametrical projection 42 thereof fitting in the center hole 15 to press up the two lead wires 5 in its position. After that the lower ends 21, 31 of the conductors 2 and 3 are inserted in the two lead wires 5 for conducting electricity.

As seen from the above description, the two conductors 2 and 3 are provided to be located in such positions that they cannot contact with each other by any means, never causing short-circuit, and besides, their length can be made as short as possible to lower the cost and the prevent short-circuit caused by mutual contact.

While the preferred embodiments of the invention have been described above, it will be recognized and understood that various modifications may be made therein and the appended claims are intended to cover all such modifications which may fall within the spirit and scope of the invention.

What is claimed is:

1. An electric lamp socket assembly for receiving an exteriorly threaded light bulb having a central longitudinal axis and providing electrical coupling to a pair of lead wires, comprising:

a longitudinally directed cylindrically contoured wall member, said wall member having an interiorly threaded surface to matingly receive said exteriorly threaded light bulb, said wall member having a longitudinally extended groove formed in said interiorly threaded surface;

a substantially flat longitudinally directed first conductor disposed within said longitudinally extended groove, said first conductor having at its lower end a piercing tab for contact with a first one of said pair of lead wires at a location displaced from said central axis;

a generally circularly contoured bottom platform positioned adjacent a lower end of said wall member and mounted at an interior perimeter thereof, said bottom platform having a transversely extending groove formed in a lower surface thereof for receipt of said lead wires therein, said lead wires extending through diametrically opposed slots formed in said lower end of said wall member, said bottom platform having a longitudinally directed opening formed therethrough adjacent said central axis of said light bulb;

a second conductor extending through said through opening of said bottom platform and having an upper bent tabbed end and a lower end formed with a piercing tab for contacting a second one of said pair of lead wires, said upper bent tabbed end being bent substantially at a right angle adjacent an upper surface of said bottom platform for extension through said central axis for defining a linearly directed conductor for contacting a bottom-end conductor of the light bulb; and, a circularly contoured bottom cap member having an upper surface for mating with said lower end of said wall member, said bottom cap member including a diametrically extended raised rib portion and two opposing longitudinally directed retaining members formed on said upper surface thereof, said diametrically extended raised rib portion presses said lead wires upwardly and securely into said transversely extended groove of said bottom platform and into electrical contact with said piercing tabs of said first and second conductors, said opposing vertically directed retaining members being received through respective openings formed in said bottom platform to lockingly engage said bottom platform.

* * * * *